US010952493B1

(12) United States Patent
Downard

(10) Patent No.: US 10,952,493 B1
(45) Date of Patent: Mar. 23, 2021

(54) FLEXIBLE FOREFOOT PROTECTION FOR INSOLES AND SHOES

(71) Applicant: Jeffrey Brian Downard, Flagstaff, AZ (US)

(72) Inventor: Jeffrey Brian Downard, Flagstaff, AZ (US)

( * ) Notice: Subject to any disclaimer, the term of this patent is extended or adjusted under 35 U.S.C. 154(b) by 190 days.

(21) Appl. No.: 15/997,656

(22) Filed: Jun. 4, 2018

Related U.S. Application Data

(63) Continuation-in-part of application No. 13/433,255, filed on Mar. 28, 2012, now Pat. No. 9,986,784.

(60) Provisional application No. 61/465,973, filed on Mar. 28, 2011.

(51) Int. Cl.

| | |
|---|---|
| ***A43B 23/00*** | (2006.01) |
| ***A43B 5/00*** | (2006.01) |
| ***A43B 13/38*** | (2006.01) |
| ***A43B 7/14*** | (2006.01) |
| ***A43B 13/18*** | (2006.01) |

(52) U.S. Cl.
CPC ..... *A43B 7/145* (2013.01); *A43B 7/1465* (2013.01); *A43B 13/186* (2013.01); *A43B 5/002* (2013.01); *A43B 13/38* (2013.01)

(58) Field of Classification Search
CPC ..... A43B 7/14
See application file for complete search history.

(56) References Cited

U.S. PATENT DOCUMENTS

| | | | | |
|---|---|---|---|---|
| 2,224,590 | A | 12/1940 | Odilon | |
| 3,084,695 | A | 4/1963 | O'Donnell | |
| 4,813,162 | A | 3/1989 | Gliege et al. | |
| 6,327,795 | B1 * | 12/2001 | Russell | A43B 13/145 36/27 |
| 6,412,194 | B1 | 7/2002 | Carlson et al. | |
| 6,954,998 | B1 * | 10/2005 | Lussier | A43B 5/02 36/107 |
| 7,082,702 | B2 * | 8/2006 | Cretinon | A43B 13/026 36/107 |
| 7,168,190 | B1 | 1/2007 | Gillespie | |
| 7,484,319 | B2 * | 2/2009 | Cheskin | A43B 7/141 36/144 |
| 7,908,768 | B2 | 3/2011 | Cheskin et al. | |
| 8,042,287 | B2 * | 10/2011 | Reinhardt | A43B 7/141 36/179 |
| 8,453,346 | B2 | 6/2013 | Steszyn et al. | |

(Continued)

*Primary Examiner* — Jila M Mohandesi
(74) *Attorney, Agent, or Firm* — Invention To Patent Services; Alex Hobson

(57) ABSTRACT

A protective plate for footwear provides protection that is flexible. A protective plate may include a forefoot plate having a ball, middle and lateral section that are configured to move and flex to enable a better feel on uneven terrain. A protective plate may extend from the forefoot to the heel and include a midfoot protective plate and a heel protective plate. Sections of the protective plate are hinged or separated to allow for a greater degree of independent movement of the three main groups of muscles and bones in the forefoot in response to walking, hiking and running on various terrain. A separate insole is described that incorporates the forefoot protection plate and that can be inserted into and removed from footwear in order to provide additional protection as needed. A shoe including outer-sole, midsole and upper, are also described having a flexible protective plate.

24 Claims, 12 Drawing Sheets

(56) References Cited

U.S. PATENT DOCUMENTS

| | | | | |
|---|---|---|---|---|
| 2006/0156580 | A1* | 7/2006 | Russell | A43B 7/1415 36/28 |
| 2010/0031530 | A1* | 2/2010 | Abshire | A43B 21/26 36/28 |
| 2013/0031804 | A1* | 2/2013 | Abshire | A43B 7/1425 36/103 |

* cited by examiner

FLEXIBLE FOREFOOT PROTECTION FOR INSOLES AND SHOES

CROSS REFERENCE TO RELATED APPLICATIONS

This application claims the is a continuation in part of U.S. patent application Ser. No. 13/433,255, filed on Mar. 28, 2012, which claims the benefit of priority to U.S. provisional patent application No. 61/465,973, filed on Mar. 28, 2011; the entirety of both are hereby incorporated by reference herein.

BACKGROUND OF THE INVENTION

Field of the Invention

The invention concerns footwear designed for walking, hiking and especially running on uneven terrain, such as trails, and comprises a protection plate that can be inserted into the shoe, incorporated into a removable insole or configured directly into the construction of shoe.

Background

Toe movement and the coordination of the parts of the forefoot are essential factors in balance and in the efficient movement of the body. See, for example, "Kick Off Your Shoes and Run Awhile", Christopher McDougall, NY Times, 23 Jun. 2005; "Is Less More, Runner's World", Bob Parks, November 2010. The ability of a wearer to coordinate the different parts of the forefoot, along with the toes, the mid-foot and the heel are dramatically affected by shoes manufactured according to different designs. Many walking, hiking and running shoes are specifically designed and manufactured for use on uneven surfaces such as trails. These trail specific shoes often have thick and sturdy outersoles, mid-soles, and "rock" pads in order to provide good protection from injury due to contact with rocks and roots. One downside of the typical design for trail specific shoes is that the materials used to provide increased protection from injury also dramatically decrease the overall sensitivity and response of the foot when the user is making contact with the ground. One reason is that the shoes do not have much flexibility from side to side to allow the users to feel the ground with the different parts of the forefoot.

Recently, walking, hiking and running shoes that have been designed and manufactured to provide greater flexibility upon the ground play important roles in walking, jogging, running, etc., and in providing and maintaining a person's bodily balance. One downside of these more "minimalist" shoes is that they do not provide as much protection for the forefoot from injury to the nerves, muscles and bones and other parts of the foot due to contact with objects such as rocks and roots on trails.

An apt description of conventional footwear is provided in U.S. Pat. No. 7,805,860. Conventional shoes generally include a sole portion and an upper formed above the sole and attached to a periphery thereof. The sole is shaped to underlie the bottom of a wearer's foot from the heel area through the arch, ball of the foot, up to and even beyond the tips of the toes. The upper extends over the sole to delimit a cavity that receives the foot.

Footwear has been constructed having protective plates and pads for the forefoot. These plates and pads provide protection against bruising and other forms of injury from gravel, rocks, roots and other similar objects, and have often been employed in shoes designed for trail running Virtually all of these shoes are designed with a single toe-cap. The typical construction of protective pads tends to treat the entire forefoot as a single functional unit in that it often provides a unitary plate that tends to deaden the sensitivity and response of the forefoot. Herein, proprioceptive sensitivity is used to mean the sense of response relating to internal muscular and connective sensitivity to the many forces involved with different kinds of exercise, while "haptic response" is used to mean a tactile sense of response relating particularly to the sense of touch associated with the feet and lower legs with respect to the ground/surface. Some efforts have been made to design protective pads and cushions that allow for increased movement as well as proprioceptive sensitivity and haptic response. See, for example, U.S. Pat. No. 5,384,973. These shoes do not, however, provide independence of movement and sensitivity for the ball, the middle section and the lateral section of the forefoot, which often serve as three functional units of the forefoot. Each of these three areas of the forefoot have unique roles in helping to maintain balance and in providing propulsion when walking, running, etc.

Footwear designed for running on smooth roads and footwear that provides a minimal amount of cushioning and support, such as the New Balance Minimus Trail and the Vibram FiveFingers Bikila, are currently being manufactured and used for the purpose of trail running Wearers have complained that these kinds of shoes do not provide adequate protection from rocks, roots and even small pebbles. Removable insole inserts have been constructed to provide multiple layers of foam and gel pads for cushioning, and structured layers of foam for support. See, for example, US Patent Numbers 2010/0095552 A1, Ser. No. 12/668,983, Ser. No. 11/833,067, U.S. Pat. No. 7,140,130. Current construction of insoles does not provide for extra protection of the forefoot from impacts on rocks and similar objects while also providing flexibility in the protective plate. We address this problem with the construction of flexible protective forefoot plates that are incorporated directly into the insoles. The insoles can be inserted by wearers into foot cavity of shoes and removed at a later time-thereby giving wearers the option of running in shoes with or without forefoot protective plates.

SUMMARY OF THE INVENTION

The invention is directed to a flexible protective plate for a shoe and a shoe incorporating the protective plate. In an exemplary embodiment, the protective plate is an insert or coupled to an insert for placement within the shoe, such as on an outsole or within the shoe bed. A protective plate may be coupled with a cushioning material, such as a foam, and may be an insole. A protective plate may be configured between the outsole and the insole and be a fixed and attached part of the shoe that is not detachable. An exemplary protective plate has two or more sections that are coupled together by a flexible element to enable independent movement of each section.

An exemplary protective plate comprises a thin hard piece of material which may be substantially planar, such as a thin sheet of plastic. An exemplary protective plate may be thin, such as no more than about 4 mm, no more than about 3 mm, no more than about 2 mm, no more than about 1.5 mm, no more than about 1 mm, no more than about 0.5 mm and any range between and including the thickness values provided, such as between about 0.5 mm and 5 mm and more preferably from about 0.5 mm to about 2 mm. A thin protective plate may be more comfortable and may weigh less, important factors for runners. An exemplary protective plate may comprise, consist essentially of or consist of a polymeric material such as a plastic, including thermoplastic or thermoset materials, including, but not limited to polyolefin, polyethylene, polypropylene, polyurethane, polystyrene, polyamide, polyimide, para-aramid, acetals, Ultem, acrylics, phenolics, aramids, ethylene-vinyl acetate (EVA), also known as poly (ethylene-vinyl acetate) (PEVA), a copolymer of ethylene and vinyl acetate, and the like. The weight percent vinyl acetate usually varies from 10 to 40%, with the remainder being ethylene in EVA. EVA can be as hard as about 80 Shore A or from about 40 to 80 Shore A. An exemplary protective plate may comprise epoxy or other relatively hard materials such as carbon or carbon fiber, metal, composites and the like. A protective plate may comprise a polymer and a filler such as a hard filler powder including but not limited to, glass, ceramic, metal, natural stone, carbon and the like. An exemplary protective plate may comprise natural materials including, but not limited to, cork, rubber, plant fibers such as hemp and the like.

An exemplary protective plate may have a hardness as measured by a shore A, shore D or Rockwell R hardness test. A medium hardness protective plate, as described herein, has a shore A hardness from about 40 to 60. A hard protective plate, as described herein, has a shore A hardness from about 50 to 80. An extra hard protective plate, as described herein, has a shore A hardness from about 80 to 100. An extremely hard protective plate, as described herein, has a shore D hardness of more than 55, or a Shore A of more than 100. An exemplary protective plate may have a hardness of about 40 shore D or more, about 60 Shore D or more, about 80 Shore D or more or a Rockwell R hardness of about 45 or more, about 70 or more, about 100 or more about 125 or more, about 150 or more or any range between and including the hardness values provided in this paragraph An exemplary protective plate may comprise a thermally formable material, whereby the protective plate can be heated, such as in an oven or heated water, such as boiling water and then placed in the shoe and formed to a person's foot. A protective plate may comprise a thermoplastic and may soften at an elevated temperature to allow the protective plate to conform to the shape of a person's foot when heated. Preferably the protective plate becomes effectively soft enough for conforming to a person's foot at a temperature that will not burn the person's foot, such as below about 80° C., below about 70° C., or even below about 50° C. An exemplary protective plate may change chemically upon heating and may cross-link, for example, which may then increase the hardness of the protective plate. For example, a thermally formable and thermally cross-linking protective plate, may be heated to a temperature to initiate cross-linking and the protective plate may be placed in a shoe and formed to a person's foot while the protective plate is still formable and upon cooling the protective plate may become harder than prior to heating. In an exemplary embodiment, a thermally formable and thermally cross-linking protective plate has an increase in Shore A hardness of about 10 or more, or preferably about 20 or more, or even more preferably about 30 or more, upon thermal forming and cross-linking.

An exemplary protective plate may comprise protective plate sections including a forefoot protective plate, a mid-foot protective plate and/or a heel protective plate. Each of these sections may comprise a single or a plurality of sections. For example, the forefoot protective plate may comprise a ball section, a middle section and a lateral section that are configured to move independently to enable proper foot movement over uneven terrain. The sections of a protective plate may be made out of different materials or have different properties, such as hardness. For example, the ball section may be harder than the middle or lateral sections of a forefoot protective plate, as the ball may have the highest impact pressures. Likewise, the forefoot protective plate may be harder than the mid-foot protective plate. The difference in hardness between sections of a protective plate may be as much as about 20% or more, about 50% or more, about 100% or more, about 200% or more and any range between and including the percentages provided.

A protective plate having two or more sections may be an integral protective plate wherein the two or more sections are a single contiguous material. In an exemplary embodiment, an integral protective plate has two or more sections formed from a single piece of material and comprises a flexible element between the sections to allow independent movement of the sections. This flexible element may be a thin portion, such as a slit or groove between the sections and/or perforations in the protective plate material between sections. An exemplary flexible element of a protective plate having two or more sections may consist of the protective plate material but have different properties, such as hardness. For example, a protective plate may have a first and second section that is a plastic having an 80 shore A hardness and a flexible element therebetween may be consist essentially of the same plastic but have a hardness of only 30 shore A.

A protective plate may comprise a single layer or two or more layers. In some cases, multiple layers may stiffen the protective plate which may be desired to prevent foot injury but may prevent forming of the protective plate to the person's foot. An exemplary protective plate may have two or more layers and the layers may comprise different materials or materials with different properties. For example, an exemplary protective plate may comprise a bottom layer having a hardness shore A hardness of 60 or more, a middle layer having a shore A hardness of less than 60 but greater than 50 shore A and a top layer having a shore A harness less than 50 shore A. The hardness of the layers descends from the bottom to the top. An exemplary protective plate may be made out of a material that has a gradient in hardness from the bottom to the top. For example, an exemplary protective plate may comprise a polymer with a filler and the filler may have a higher concentration at the bottom than at the top thereby making the bottom portion of the protective plate harder than the top. In another example, a protective plate comprises pores, such as air-bubbles, and the concentration and/or size of these air bubbles may be higher toward the top surface than the bottom surface thereby making the bottom portion of the protective plate harder.

An exemplary protective plate may comprise separated protective plate sections which may be coupled together by a flexible element. An exemplary flexible element extending between the protective plate sections may comprise different materials than the protective plate and may comprise, consist essentially of or consist of plastic, elastic material, or cushioning material having a hardness less than that of the protective plate, such as plastic or foam. In an exemplary embodiment, a flexible element extends between the two discrete protective plate sections and is configured in the space or gap between them. In an exemplary embodiment, a flexible element extends across the top and/or bottom surfaces of two adjacent protective plate sections.

Two or more of the protective plate sections may form the protective plate. For example, an integral forefoot protective plate having three protective plate sections, a forefoot section, a mid-foot section and a heel protective plate section, may be made from a single piece of material and may comprise a flexible element, such as a thin portion to enhance flexibility between the protective plate sections. For example, a forefoot protective plate may be coupled to the mid-foot protective plate and a thin portion may extend between them to allow better flexibility between the two adjacent protective plate sections. A flexible element may be a different material between sections of a protective plate, such as between the forefoot, mid-foot and heel protective plates, or between sections of these plates, such as along the mid-foot protective plate, or between the ball section, middle section and/or lateral section of the forefoot plate.

The invention is for a flexible forefoot protection plate, an insole that incorporates the protection plate, and a shoe with three forefoot pads and three toe compartments. The "rock" protection plate, as it is often called in the running shoe industry, is comprised of three main sections. The sections of the protection plate are hinged or separated to allow a greater degree of independent movement of the three main groups of muscles and bones in the forefoot in response to varying walking, hiking and running terrain. The flexibility of the forefoot plate provides a balance between optimal protection at the same time that it allows increased proprioceptive sensitivity and haptic response as compared to what is currently available in the manufacture of shoes having a single protection plate in the forefoot of the shoe. The partially or fully independent sections of the protection plate correspond to the three main areas in the forefoot (i.e., the ball, the middle and the lateral sections). In current manufacture of trail running shoes, protective forefoot pads are typically incorporated into or between the outer sole and the midsole of the shoe.

The invention includes an insole that incorporates the forefoot protection plate and that can be inserted into and removed from footwear in order to provide additional protection as needed. It also includes a shoe that is comprised of an outer-sole, midsole and upper in which the forward portion is divided into three toe compartments and the midsole and outer-sole are comprised of three pads that are designed to strike a balance between increased independence of movement of the three groups of toes along with ease of putting the shoes on the feet as compared to shoes with five toe compartments. The shoe may include the forefoot protection plate between the midsole and outer sole.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

In the attached figures, like elements are numbered alike.

Figure 1:
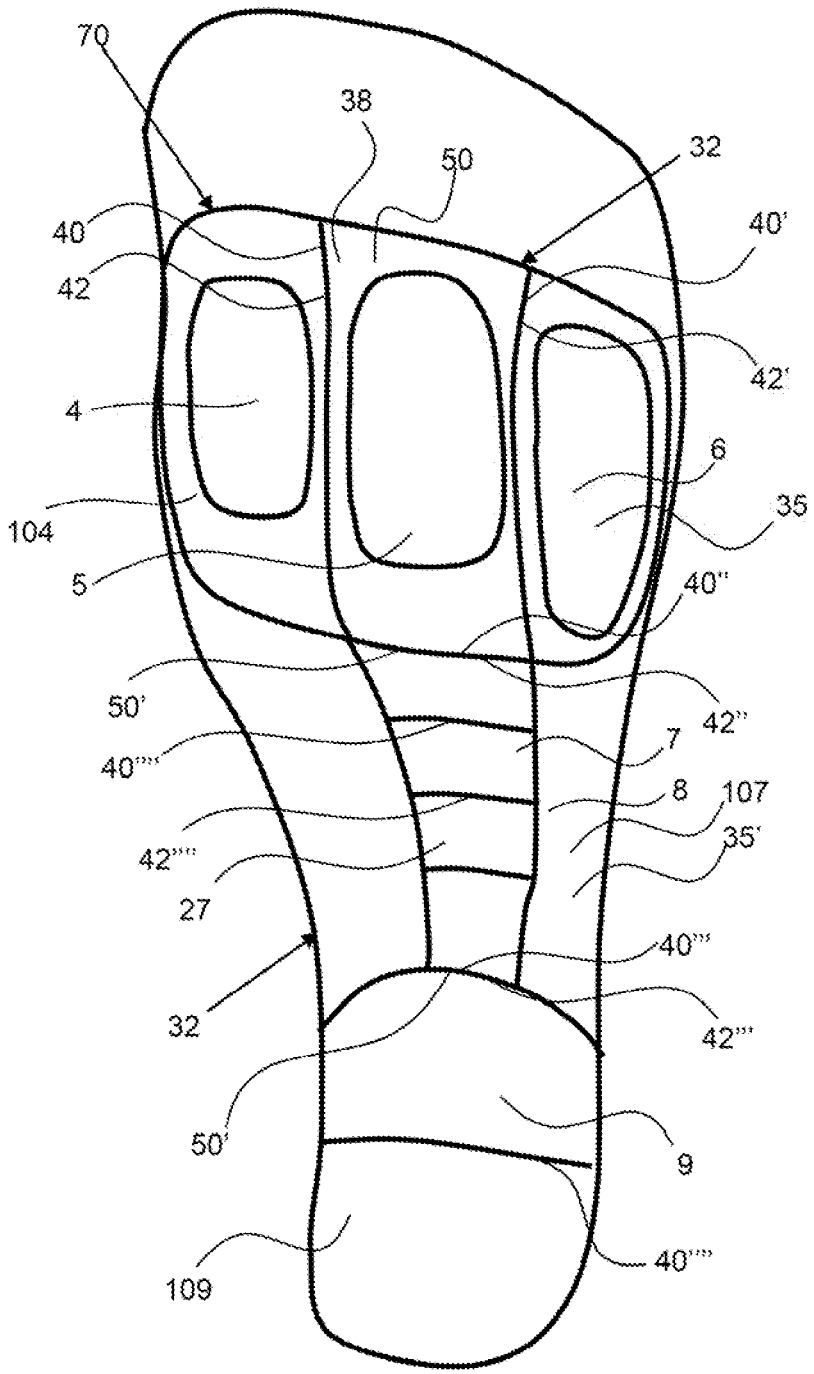
FIG. 1 shows a bottom plan view of footwear showing the approximate location of protective plates for the forefoot according to the present invention.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

1. Toe compartment for large toe;
2. Toe compartment for middle two toes;
3. Toe compartment for lateral two toes;
4. Forefoot protective plate for ball of forefoot;
5. Forefoot protective plate for middle section of forefoot;
6. Forefoot protective plate for lateral section of forefoot;
7. Middle section of mid-foot protective plate;
8. Lateral section of mid-foot protective plate;
9. Heel section of protective plate;
10. Cavity for foot;
11. One iteration of adjustable straps to hold footwear securely to foot;
12. Out-sole;
13. Single toe cap as found on a typical footwear;
17. Large outsole lugs typical for trail running shoes;
18. Foam midsole;
19. Insole constructed from EVA. Polyurethane or other foam, cork or other similar material;
20. Toes and phalange bones;
21. Metatarsal bones;

22. Neuroma between middle and lateral pairs of phalanges and metatarsals;

23. Normal nerve between phalange and metatarsal of the large toe and the middle pair of metatarsals

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Definitions

A shoe bed is within a shoe and typically defined by the area above the outsole and defined by the perimeter of the outsole is configured within the interior volume created by the upper.

Figure 14:
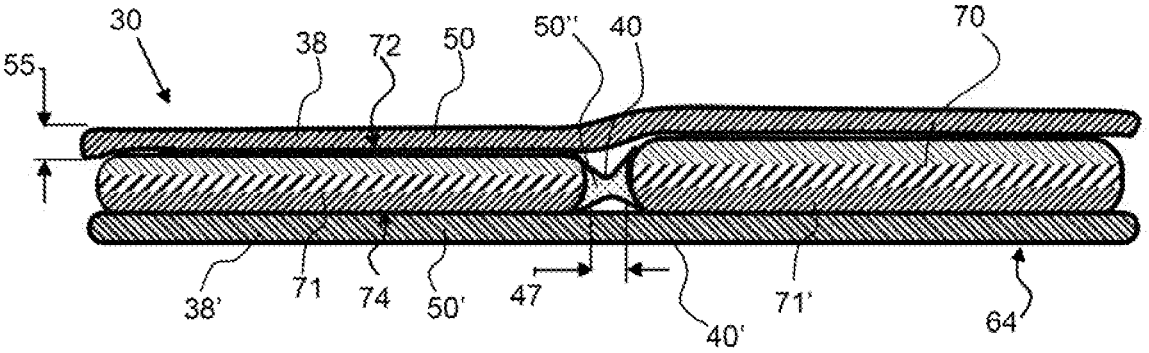
FIG. 14 shows a cross-sectional view of an exemplary insole comprising an exemplary protective plate.

As shown in FIG. 1, a protective plate 70 comprises a forefoot protective plate 104, a mid-foot protective plate 107 and a heel protective plate 9. The protective plate insert 32 may be configured for insertion and removal within a shoe. The forefoot protective plate is a composite protective plate 35 comprising three distinct protective plate sections, a ball section 4, a middle section 5 and a lateral section 6. The mid-foot protective plate is also a composite protective plate 35' comprising a middle section 7 and a lateral section 8. The forefoot protective plate may be attached to the mid-foot protective plate and the mid-foot protective plate may be attached to the heel protective plate. The protective plate 70 may be an integral protective plate, whereby the protective plate is made from a single piece of material and may comprise thin portions 42 between protective plate sections, such as the forefoot 104, mid-foot 27 and heel 109 sections to increase flexibility. The protective plates may be coupled to a cushioning material 38 and may be configured as a protective plate insole 30 and the cushioning material may extend beyond the protective plates and have the shape of a foot-bed of a shoe, whereby the protective plate insole is retained by the foot bed perimeter 95 of the upper portion 92 of the shoe 90 as shown in FIG. 14. The protective plates have flexible elements 40-40"" between portions or sections to increase flexibility. These flexible elements may be a flexible or elastic material such as plastic, urethane, an elastomer such as silicone or rubber and the like. A flexible element may be a cushioning material 38 that extends across two or more protective plate sections to act as a connecting material 50. A protective plate section, such as the forefoot portion or mid-foot portion may comprise flexible elements 40 to increase flexibility across the protective plate section. Sections of a protective plate may be attached to a connecting material 50, such as a sheet of plastic, and this connecting material may be coupled or attached to a cushioning material 38 to produce a protective plate insole that fits within a foot bed such as on top of an outsole.

Figure 2:
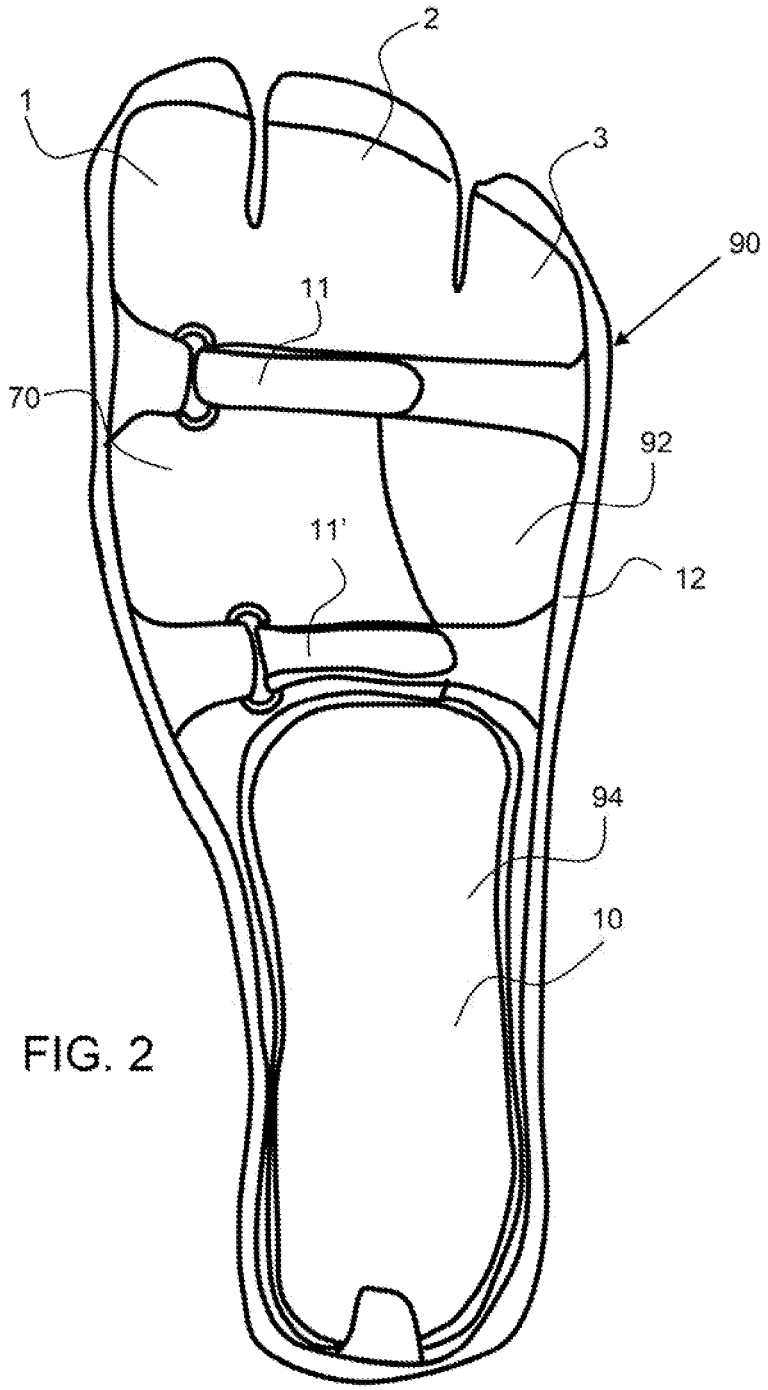
FIG. 2 shows a top plan of the footwear showing three toe compartments according to the invention.
Figure 3:
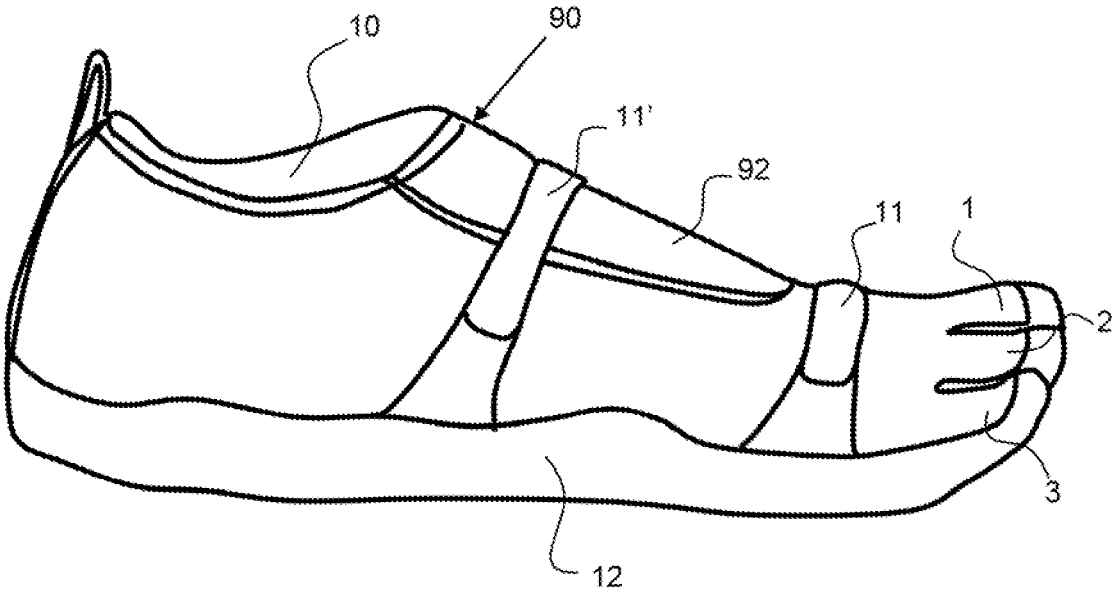
FIG. 3 shows a side elevation view thereof.
Figure 4:
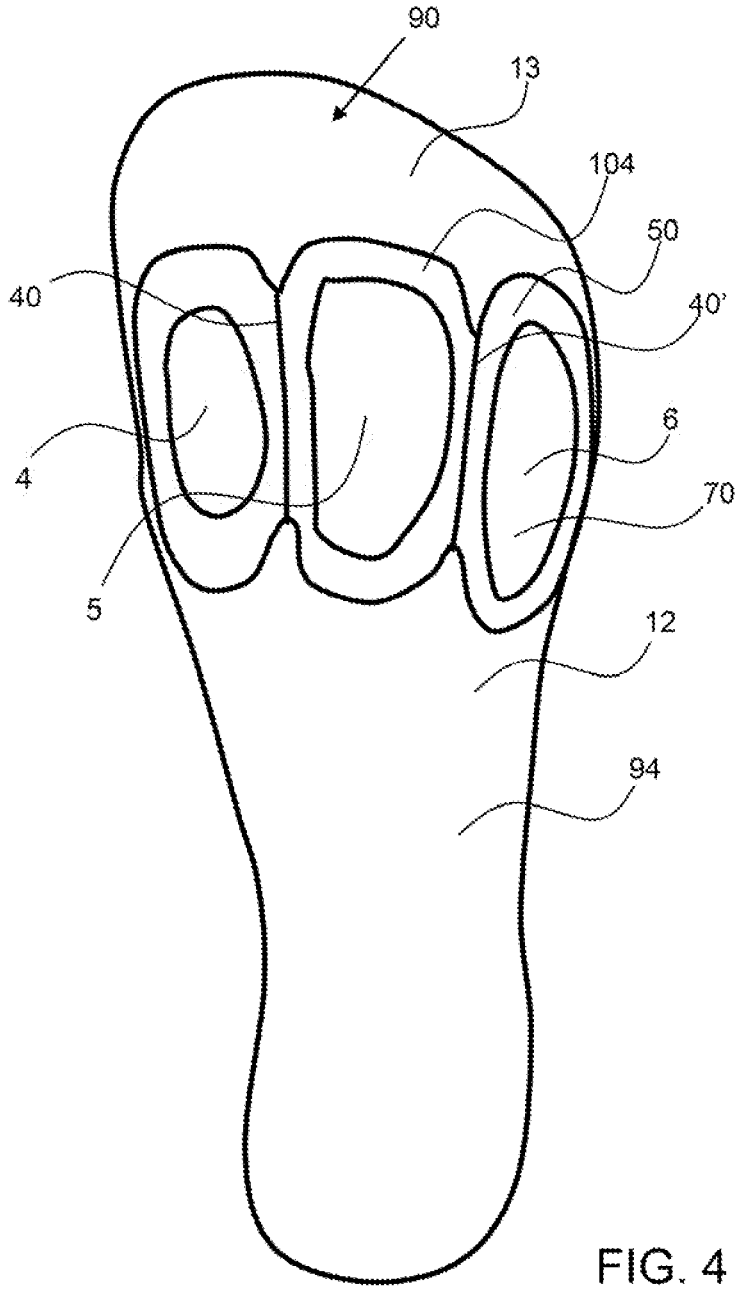
FIG. 4 shows a bottom plan of the footwear with three relatively independent forefoot protective plates in a shoe with a single toe box.

Referring now to FIGS. 2 to 4, an exemplary protective plate 70 is configured within a shoe 90. The protective plate is part of the shoe and is located above the bottom portion of the outsole 12 and extends over a portion of the foot bed 94. A cushioning material 38 is configured over the exemplary protective plate. The shoe 90 has straps 11, 11' to secure the shoe to the user's foot, and a cavity 10 for receiving the foot. This exemplary shoe has discrete toe compartments, a toe compartment for the large toe 1, a toe compartment for the middle toes 2 and a toe compartment for the lateral toes 3.

As shown in FIG. 4, the exemplary protective plate 70 comprises a forefoot protective plate 104 having three sections, a ball section 4, a middle section 5 and a lateral section 6. A flexible element 40, 40' is configured between the discrete sections of the forefoot protective plate. The flexible element enables independent movement of the sections with respect to each other. The discrete sections of the forefoot plate may be coupled together by a connecting material 50, such as a plastic material, and the connecting material may be flexible and act as the flexible element between the discrete sections of the forefoot plate. The connecting material may be thinner than the discrete forefoot plate sections and may be a material that is softer, having a shore A value of at least 20 less than the shore A value of the protective plate sections. The forefoot protective plate is configured above the outsole 12 and within the foot bed 94. An insole may be configured over the outsole of the forefoot protective plate to provide cushioning and support of the foot.

Figure 5:
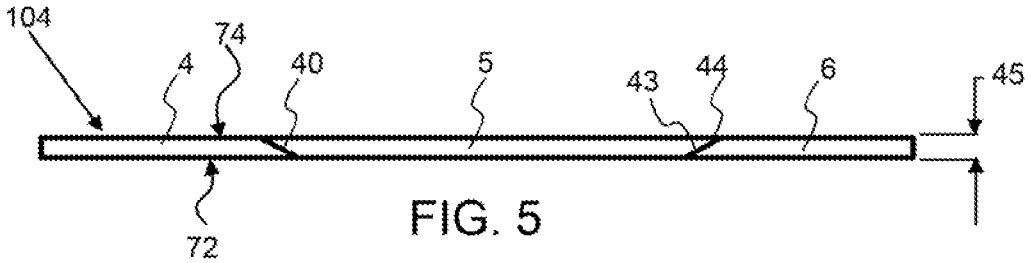
FIG. 5 shows a cross section of a forefoot protective plate that is completely divided into three separate pieces allowing for relative independence movement of each plate.
Figure 6:
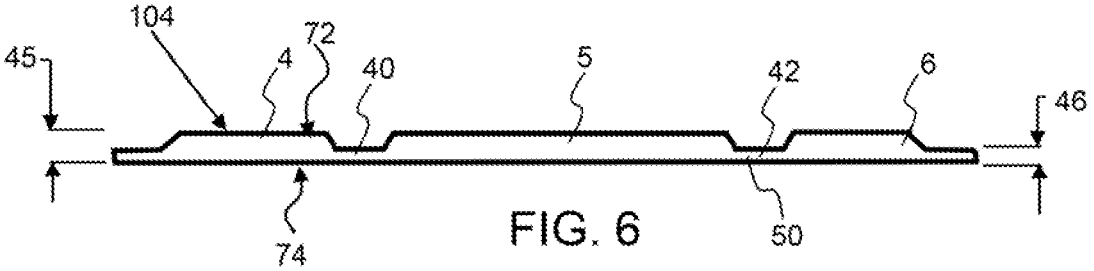
FIG. 6 shows a cross section of a single forefoot protective plate that is divided into three sections corresponding to the ball, middle portion and lateral portion of the foot by varying the thickness of the plate to allow for relative independence movement of each plate as the shoe bends to fit the varying contour of the ground.
Figure 7:
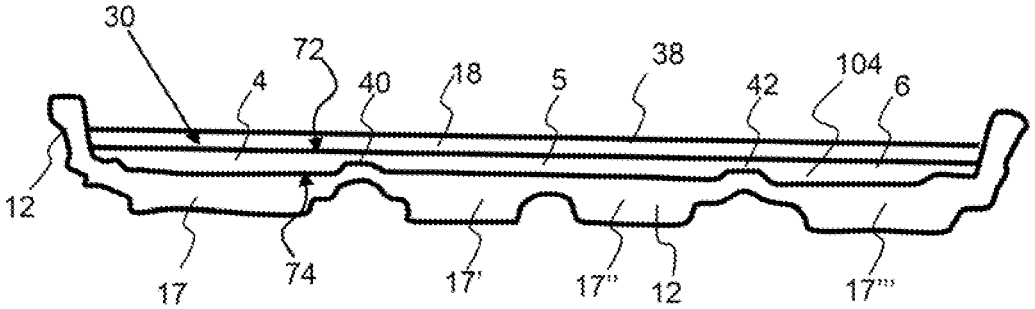
FIG. 7 shows a cross section of a forefoot protective together with the foam mid-sole and an outsole.

Referring now to FIGS. 5 to 7, a forefoot protective plate 104 comprises a ball section 4, a middle section 5 and a lateral section 6. A flexible element 40, 40' is configured between the discrete sections of the forefoot protective plate. As shown in FIG. 5, the flexible element is a slit 44 or perforations 43 in the protective plate material. The protective plate has a thickness 45 from a top surface 72 to a bottom surface 74 as shown in FIG. 5. As shown in FIG. 6, the flexible element 40, or connecting material 50, is a thin portion 42 between the discrete sections of the protective plate. The thin portions may have a thickness 46 which may be substantially thinner than the thickness of the discrete sections, such as at least about one half of the thickness of the discrete sections. As shown in FIG. 7, the forefoot protective plate 104 is configured between an outsole 12 and a cushioning layer, such as a midsole or insole 18, which may be a foam. The outsole has lugs that extend out to provide traction for running, such as is commonly found on a trail running shoe.

Figure 8:
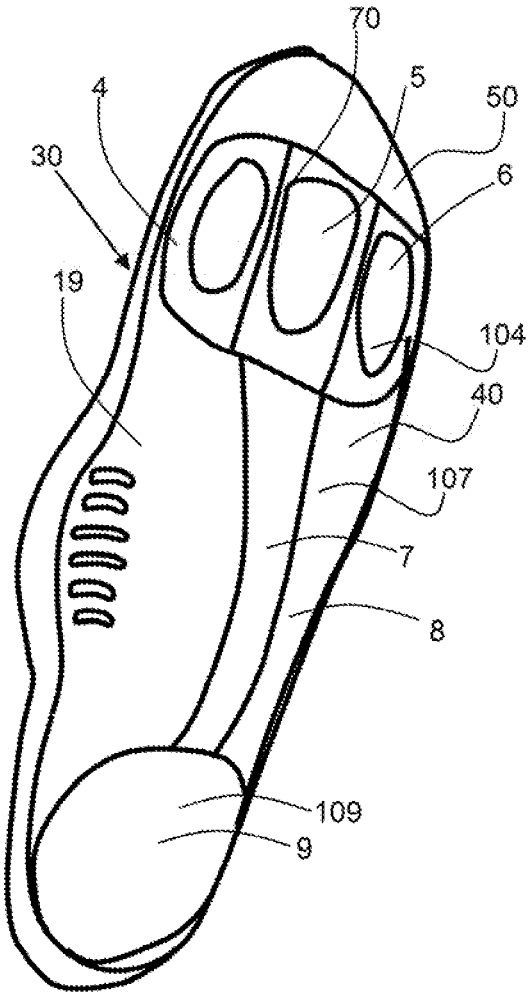
FIG. 8 shows a perspective bottom view of removable insoles with forefoot protective plates.
Figure 9:
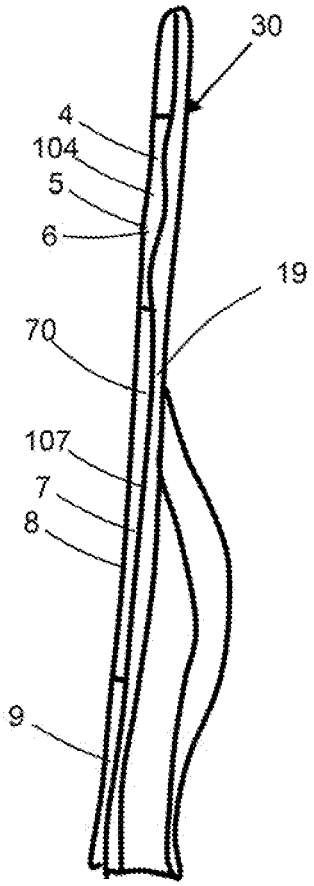
FIG. 9 shows a side view of the removable insoles with forefoot protective plates.

Referring now to FIGS. 8 and 9, an exemplary protective plate 70 is part of an insole 19. The exemplary protective plate insole 30 comprises a forefoot protective plate 104, a midfoot protective plate 107 and a heel protective plate 9. The forefoot protective plate 104 has three sections, a ball section 4, a middle section 5 and a lateral section 6. The midfoot protective plate has a middle section 7 and a lateral section 8. The insole may couple the discrete sections of the protective plate together and may act as the flexible element 40, or connecting material 50 between the discrete protective plate sections. The insole may be shaped to support a user foot as best shown in FIG. 9 and the insole may be made of a thermally formable material, such as a foam, whereby the protective plate insole may be heated to an effective temperature and then placed in a shoe and formed around a person's foot inserted into the shoe. As shown in FIG. 8 and with reference to FIG. 10, the ball section of the forefoot plate is configured to extend at least partially under the interphalangeal joint, or where the first proximal phalange bone joins the metatarsal, under the ball of the foot. An exemplary ball section of the forefoot plate may be designed to be hinged or entirely separate from the other forefoot protective plate sections. The middle section 5 of the forefoot plate has a shape and is configured at least partially under the second and third interphalangeal joints and may extend at last partially under the second and third proximal phalanges and under the second and third metatarsals. The lateral section 6 of the forefoot plate has a shape and is configured at least partially under the fifth interphalangeal joint and may extend at last partially under the forth interphalangeal joint and may extend at least partially under the forth and fifth proximal phalanges and under the forth and fifth metatarsals. One or more of the ball, middle and lateral sections may extend substantially over the entire metatarsal.

Figure 10:
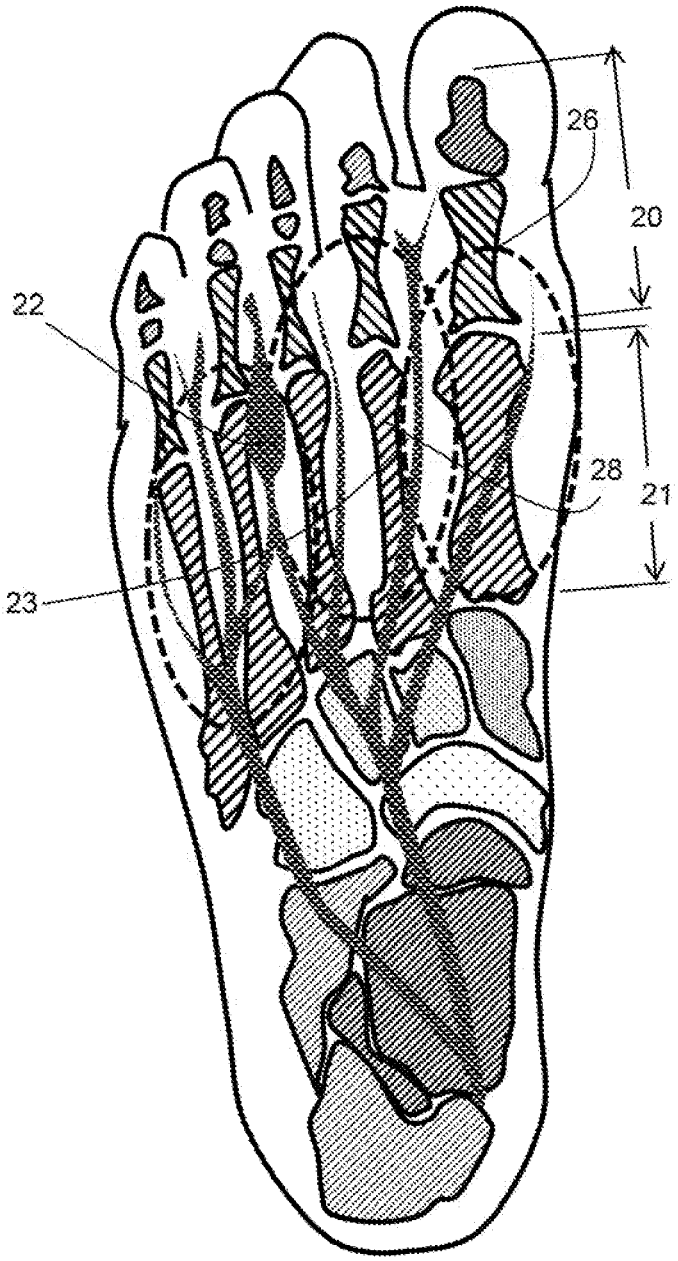
FIG. 10 shows a bottom view of the major bones and nerves in the foot.

As shown in FIG. 10, a foot has a plurality of bones that extend from the heel and middle foot up to the end of the toes. The foot has a toe area 20 extending over the area comprising the phalange bones 26, and a metatarsal area extending along the length of the foot comprising the metatarsal bones 28. A neuroma 22 is shown formed between middle and lateral pairs of phalanges and metatarsals. A Normal nerve 23 is shown between phalange and metatarsal of the large toe and the middle pair of metatarsals. The length of the toe area and length of the metatarsal area will vary from person to person.

Figure 11:
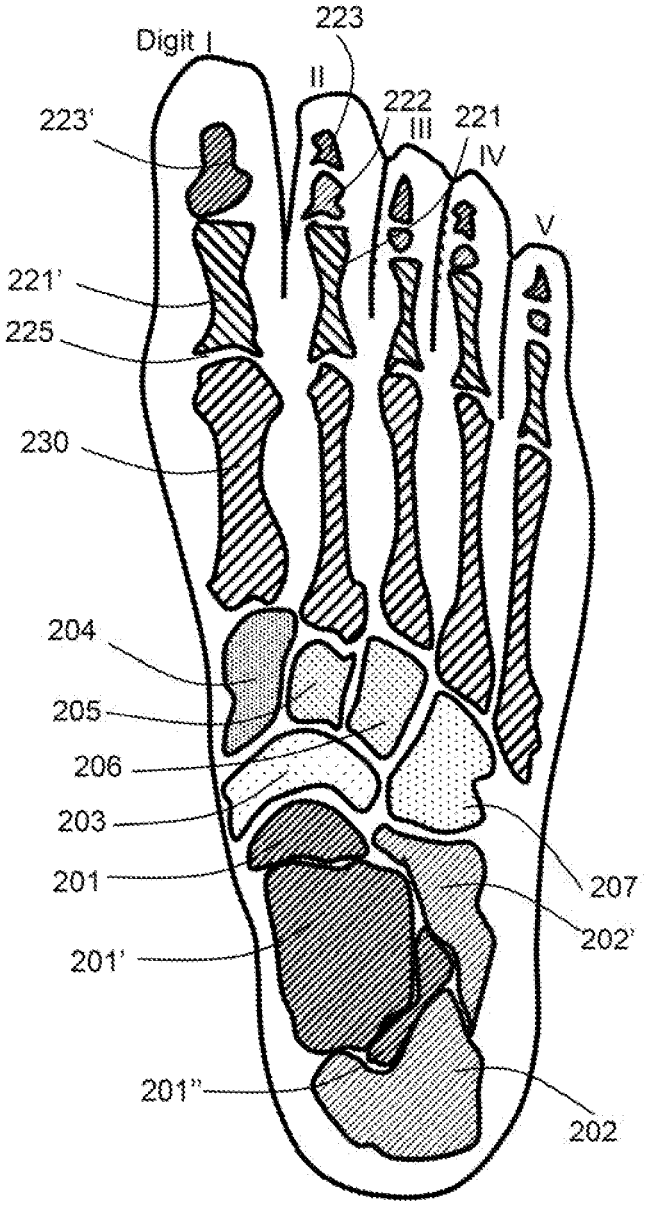
FIG. 11 shows a diagram of the anatomy of a foot.
Figure 12:
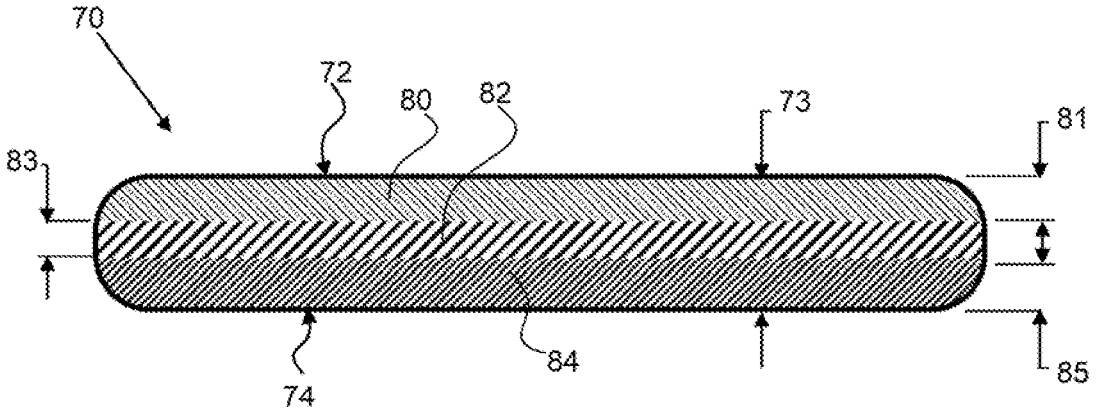
FIG. 12 shows a cross-sectional view of an exemplary protective plate.

FIG. 11 shows the bone structure of a foot. The bones are listed in Table 1. Note that digit I, the "big toe", only has a distal phalange 223 and a proximal phalange 221, all the other digits, II-V, have a distal phalange 223, medial phalange and a proximal phalange 221. As described herein, the forefoot protective plate may be configured under the interphalangeal joint 225 between the metatarsal bone and the proximal phalange bone. The midfoot protective plate may be configured under the cuneiform bones, the cuboid bone and at least partially under the talus, calcaneus, and navicular bones. The heel protective plate may be configured under the calcaneus 202 and at least partially under the calcaneus 202', as well as any of the talus bones.

TABLE 1

| | |
|---|---|
| 201 | Talus |
| 202 | Calcaneus |
| 203 | Navicular |
| 204 | Cuneiform I |
| 205 | Cuneiform II |
| 206 | Cuneiform III |
| 207 | Cuboid |
| 221 | Phalanges proximal |
| 222 | Phalanges medial |
| 223 | Phalanges distal |
| 225 | Interphalangeal joint |
| 230 | Metatarsal |

Figure 13:
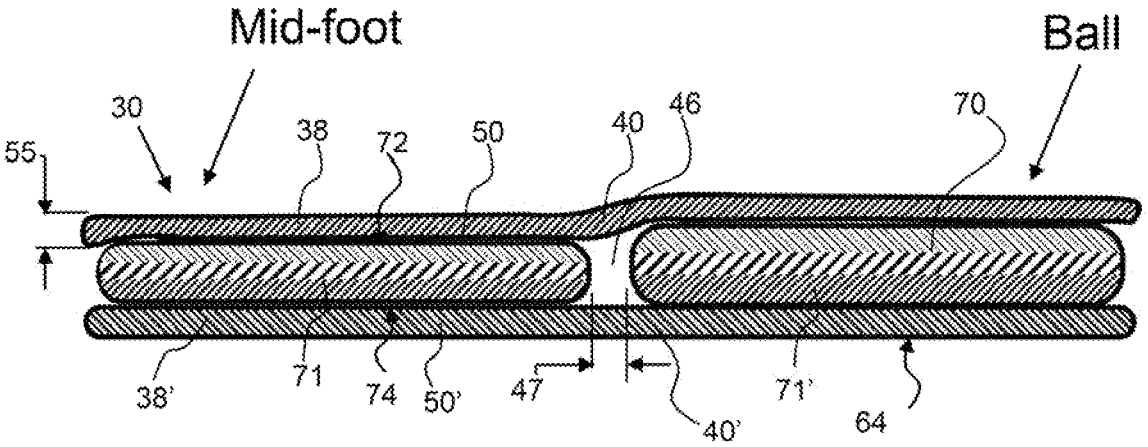
FIG. 13 shows a cross-sectional view of an exemplary insole comprising an exemplary protective plate.

Referring now to FIGS. 12 to 16, an exemplary protective plate 70 has a thickness 73 from a top surface 72 to a bottom surface 74. A protective plate may comprise multiple layers of material that are different materials or a common material with different properties, such as hardness. For example, an exemplary protective plate may comprise a top layer 80, a middle layer 82, and a bottom layer 84, or layer closes to the outsole or bottom of the shoe. Each of these layers may have a different thickness and may have different hardness values. A top layer 80 having a thickness 81 may be a softer material than the middle or bottom layer. A middle layer 82, having a thickness 83, may have an intermediate softness that is between the top and bottom layers. The bottom layer 84, having a thickness 85, may be the hardest layer. As shown in FIG. 13, a protective plate 70 may comprise separate section 71, 71', that are coupled together by a connecting material 50. 50'. The connecting material may act as a flexible element 40 to allow independent movement of the separate protective plate sections. A connecting material 50, may extend over the top surface 72 of the protective plate and may be a cushioning material 38. A connecting material 50' may extend along the bottom surface 74 of the protective plate and may have a high friction surface 64 to prevent slippage and movement of within a shoe. Discrete protective plate sections may be coupled together by a connecting material to form a protective plate insole 30. As shown in FIG. 13, there may be a space of gap 46 having a gap width 47 between the two protective plate sections to allow independent movement of the discrete protective plate sections. A protective plate or section of a protective plate may have any number of flexible elements or gaps that extend along the length and/or across the protective plate to provide additional flexibility. For example, one or more of a forefoot protective plates may have a slit, gap or connecting material that extends from a location proximal the mid-foot or mid-foot protective plate to the extended end of the forefoot protective plate, or the end proximal the end of the toes. A forefoot protective plate may be discrete sections that are separate from the mid-foot protective plate to the extended end. A forefoot protective plate may be separate or independent from a mid-foot protective plate and may have a slit, gap or connecting material that extends from one side to the other, such as along the length of the foot or toes for example. As shown in FIG. 14, a connecting material 50" may be configured within the gap between the discrete protective plate sections. A single connecting material may extend over the top surface, the bottom surface and/or within the gap between discrete protective plate sections to connect the protective plate sections together.

Figure 15:
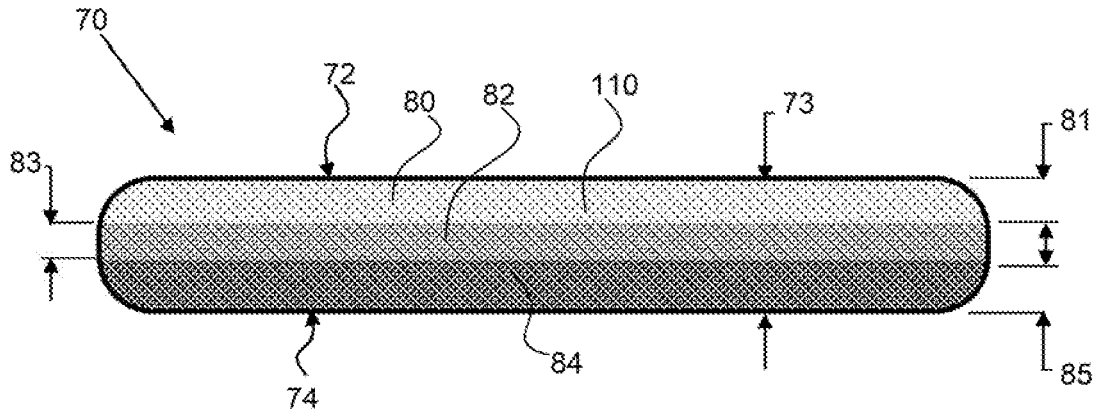
FIG. 15 shows a cross-sectional view of an exemplary protective plate comprising pores.

As shown in FIG. 15, an exemplary protective plate 70 comprises pores 110, such as air-bubbles and may be a foam material. Processing of a foam, such as a styrene foam which can be made relatively hard having a hardness of greater than about 40 shore A, may produce a foam with a gradient of pores from a top surface 72 to the bottom surface 74. The gradient may be in pore volume concentration, size and/or quantity of pores. As shown in FIG. 15, the concentration of pores is highest toward the top surface 72 and lowest toward the bottom surface 74. The bottom surface may have very few pores and/or be substantially a full density material having less than 5% void volume. The top layer 80, or portion, may have a higher concentration of pores, such as at least 10% or more. The difference in the volumetric concentration of pores between the top and the bottom layers or portions may be 50% or more, 100% or more, 200% or more and any range between and including the difference values provided. A foam may have a skin layer that may have a hardness as defined hereinsuch as greater than about 40 or 50 Shore A durometer. A protective plate having a skin layer or near full density layer toward the bottom surface and 74 and pores 110 toward the top surface may provide protection and cushioning in one integral material.

Figure 16:
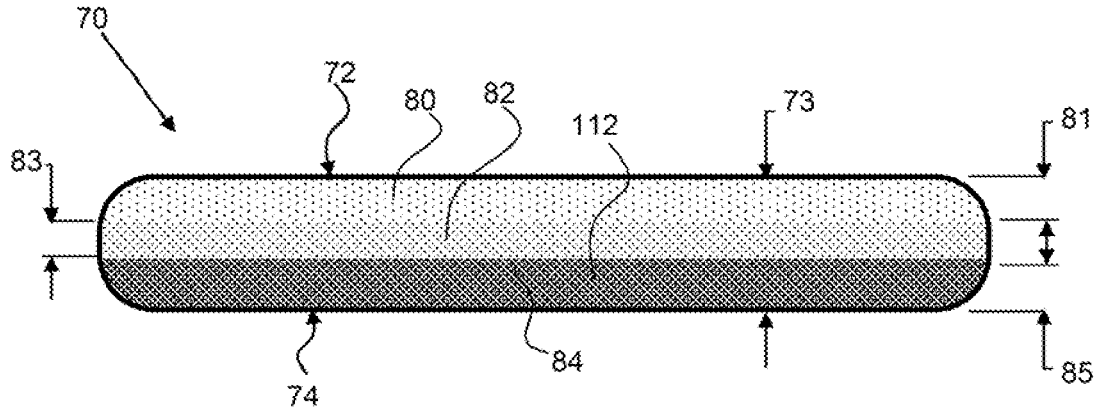
FIG. 16 shows a cross-sectional view of an exemplary protective plate comprising pores.

As shown in FIG. 16, an exemplary protective plate 70 comprises filler 112, such glass particles, or glass spheres. Processing of filled plastic can produce a composite plastic having a gradient of filler concentration through the thickness as shown. As shown in FIG. 16, the concentration of filler is highest toward the bottom surface 74 and lowest toward the top surface 72. The bottom layer 84, or portion, may have a volumetric concentration of filler that is at least double that of the top layer 80 or portion of the protective plate. The difference in the volumetric concentration of filler between the bottom and the top layers or portions maybe 50% or more, 100% or more, 200% or more and any range between and including the difference values provided.

Figure 17:
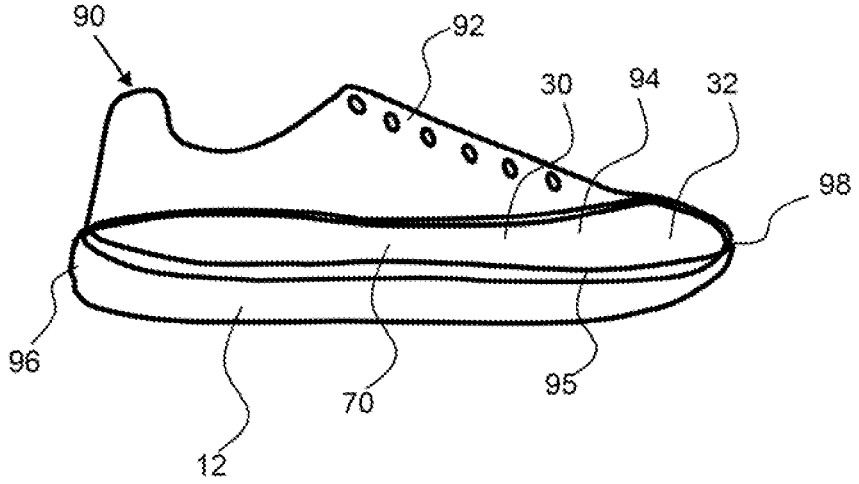
FIG. 17 shows an exemplary shoe having an exemplary protective plate configured therein.

As shown in FIG. 17, an exemplary shoe 90 has an upper portion 92 a foot bed 94, an outsole 12 and a length from a heel end 96 to a toe end 98. A protective plate 70 is configured within the shoe foot bed and is a protective plate insert 32, such as a protective plate insole 30.

Figure 18:
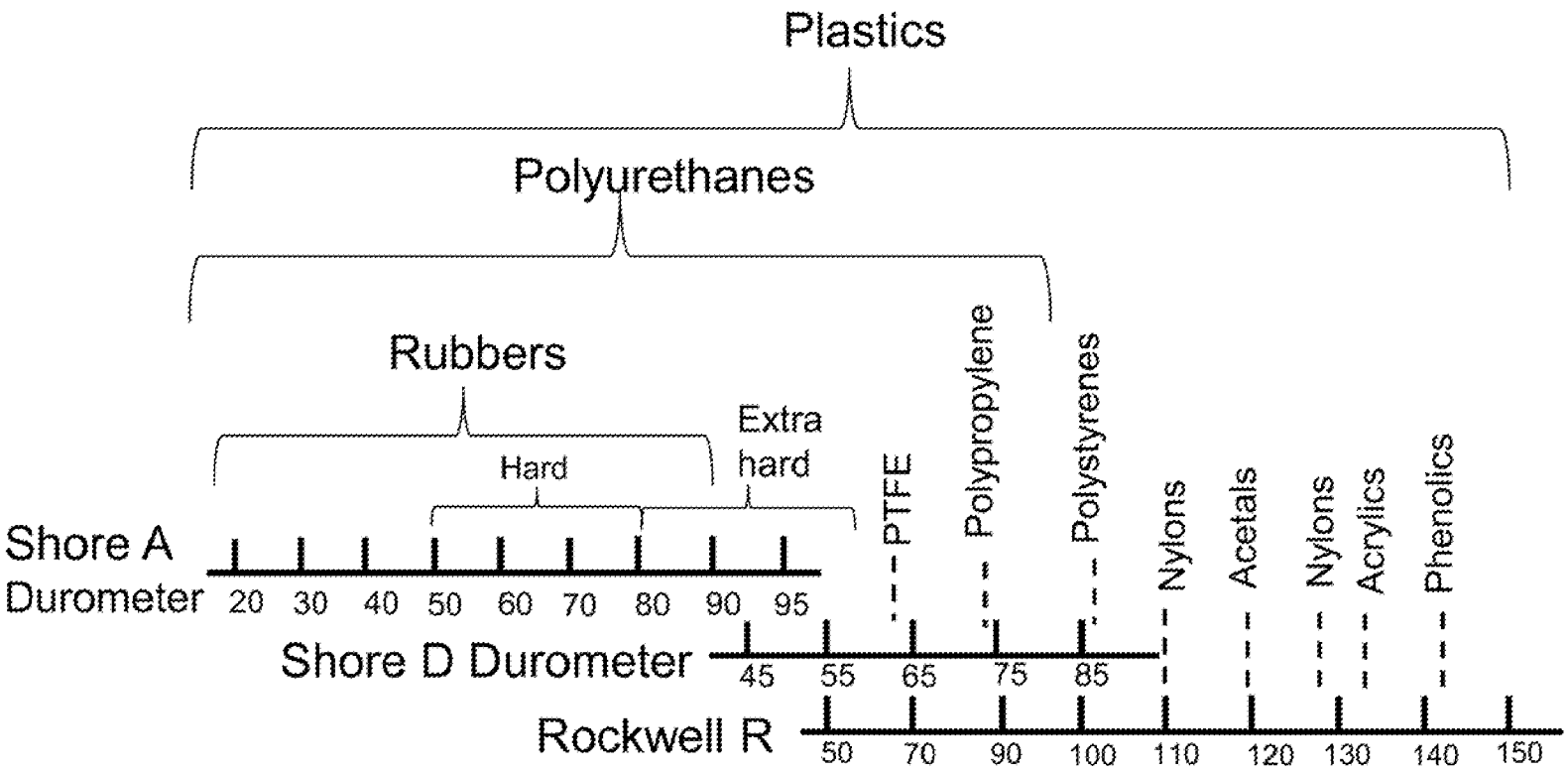
FIG. 18 shows a graph of hardness values for different types of materials.

As shown in FIG. 18, a chart shows the hardness value for a variety of materials including rubber, and polymeric materials such as polyurethanes, and plastics. As shown, a hard protective plate has a Shore A hardness of 50 to 80 and an extra hard protective plate has a Shore A hardness of 80 to 100. Note that plastics can have a hardness from Shore A 20 or less to more than 140 on the Rockwell R scale. An exemplary protective plate or the sections thereof, may comprise, consist essentially of, or consist of a plastic that has a Shore A hardness of at least 40 and preferably greater than 50 and may be comprised of formable plastic such as EVA.

These problems and deficiencies of the prior art are overcome or alleviated by the invention that provides novel and non-obvious "rock" protection plate for the forefoot, along with insole, mid-sole, outer sole and toe-box devices for increased protection, freedom of movement, sensitivity and response. The invention provides three protective pads or plates comprised of various combinations of outsole, harder plastic (typically nylon, TPU, rubber or similar material) protective rock plate and foam midsole. These components may be formed separately or together. The three forefoot plates provide extra protection for the three groups of bones, muscles, ligaments and tendons in the forefoot. These groups correspond to the ball of the foot, the middle group, and the lateral group. In some iterations of the footwear, the three protective pads and plates are combined with the three separate compartments for the toes. This arrangement has the advantage of increasing the independence of movement, sensitivity and response of the three sets of toes and three related parts of the forefoot and the coordination between each of the toes and parts of the forefoot.

The invention provides for separate insoles that incorporate protective plates for the forefoot, mid-foot, and/or heel. Insoles for running and walking footwear are currently manufactured and sold separately for shoes. The invention provides the novelty of incorporating one or more protective rock plates into the manufacture of the insole. In addition to incorporating forefoot plates designed to provide semi or complete independence for the three parts of the forefoot, we also claim invention of insoles with a single forefoot, mid-foot, and/or heel protective plate. These insoles can be easily installed or removed, thereby giving wearers of footwear designed for running on relatively smooth surfaces and minimalist footwear the ability to add additional protection against injury from rocks by inserting the insoles with protective plates and then removing the insoles at a later time when running on a smooth surface such as a road and the extra protection is no longer needed. This represents a significant increase in utility of insole construction. The insoles are shaped to fit shoes with a single toe-cap or to fit shoes with two, three, four or five separate toe compartments.

The invention additionally provides a footwear including a sole, an upper, and a arrangement of straps, laces or other devices configured to secure the footwear to the foot of a wearer, where the sole and the upper delimit three toe compartments configured to receive, retain, and allow articulation of corresponding individual toes and pairs of toes inserted in the footwear. These three toe compartments allow a high degree of movement, sensitivity and response by the large toe, along with the middle and the lateral pairs of toes. The sole may include contouring and curvature which corresponds to the shape of the foot, and where the sole, midsole and upper are disposed to provide an enhanced range of movement, proprioceptive sensitivity and haptic response to the wearer.

In one paradigm case, the sole is comprised of an exterior sole with lugs for improved traction made of a rubber material of approximately 2-15 mm in thickness, a protective plate of a harder nylon TPU, plastic, rubber or similar material that varies between 1-3 mm in thickness, and a foam midsole of 2-20 mm in thickness. The layers needed in a given kind of shoe and the particular thickness of each layer depend upon the intended use of the footwear. The width, length, and shape of the forefoot protective plate or plates may vary depending upon the intended purpose of the footwear and other factors including the size and shape of the foot of the intended wearer. Shoes designed for running on padded tracks will typically have fewer layers or less material in the sole, while those designed for use on rough trails will have more protection and padding. The arrangement of the protective plates and pads can be made with variable thicknesses of the harder plastic, rubber or other similar material so that the thicker portions will be located directly below the most sensitive bones in the forefoot, and the thinner portions on the borders between the three areas to allow for relative independence of movement, sensitivity and response. In other iterations, the three pads may be partially or completely separated from one another in the process of constructing the shoe.

These features and advantages of the apparatus and method will be appreciated and understood by those skilled in the art from the drawings and detailed description.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A shoe comprising a protective plate, said protective plate comprising:

a) a forefoot protective plate located over a forefoot portion of, said shoe and comprising:
   i) a ball section having a thickness of 0.5 to 5 mm and a shore A hardness of at least 50;
   ii) a middle section having a thickness of 0.5 to 5 mm and a shore A hardness of at least 50; and
   iii) a lateral section having a thickness of 0.5 to 5 mm and a shore A hardness of at least 50;

wherein the ball section is configured under a ball portion of said foot when said foot is inserted into said shoe;

wherein the middle section is located between the ball section and the lateral section;

wherein the forefoot protective plate is a single piece of material and comprises a thin portion having a thickness of no more than 3 mm between the ball section and middle section to provide independent movement of the ball section and middle sections;

said shoe comprising:

a) an outsole having a plurality of lugs and lug grooves located between the lugs for improved traction; wherein the lug grooves are thinner than the lugs; wherein the outsole has a lug groove between the ball section and middle section of the forefoot protective plate;

b) an upper coupled to the outsole and extending over the outsole;

c) an insole comprising a foam layer;

wherein the forefoot protective plate is configured between the outsole and the insole; and wherein the thin portion of the forefoot protective plate is aligned between adjacent lugs of the outsole and with the lug groove between the ball section and middle section of the forefoot protective plate to provide independent movement of the ball section and middle sections.

2. The shoe of claim 1, wherein the thin portion in the forefoot protective plate is a groove having a thickness of 0.5 mm to 3 mm.

3. The shoe of claim 1, wherein the forefoot protective plate comprising of a hard plastic having a shore A hardness of at least 60.

4. The shoe of claim 1, wherein the forefoot protective plate is thermoplastic.

5. The shoe of claim 1, wherein the ball section, middle section and lateral section are extra hard and have a shore A hardness of at least 80.

6. The shoe of claim 1, wherein at least one of the ball section, middle section and lateral section comprise two or more layers.

7. The shoe of claim 1, wherein at least one of the ball section, middle section and lateral section comprise a filler.

8. The shoe of claim 7, wherein the concentration of the filler is higher proximal to a bottom surface than a top surface.

9. The shoe of claim 1, wherein at least one of the ball section, middle section and lateral section comprise a plurality of pores.

10. The shoe of claim 9, wherein the concentration of the plurality of pores is higher proximal to a top surface than a bottom surface.

11. The shoe of claim 1, wherein the forefoot protective plate is detachably attachable to the shoe and is an insert.

12. The shoe of claim 1, wherein the insole is attached to a top surface of the forefoot protective plate; wherein the protective plate and insole form a detachably attachable insole to said shoe.

13. The shoe of claim 1, wherein the thin portion comprises a slit in the forefoot protective plate.

14. The shoe of claim 1, comprising a gap between at least two of the forefoot protective plate sections.

15. The shoe of claim 1, comprising a gap between the ball section and the middle section and a gap between the middle section and the lateral section.

16. The shoe of claim 1, wherein the protective Mate further comprises:

a) a midfoot protective plate coupled to the forefoot protective plate.

17. The shoe of claim 16, wherein the forefoot protective plate and midfoot protective plates are a single piece of material.

18. The shoe of claim 17, comprising a thin portion in the forefoot protective plate having a thickness of no more than 3 mm between the forefoot protective plate and midfoot protective plate to provide independent movement of the forefoot protective plate and midfoot protective plates.

19. The shoe of claim 16, wherein the protective plate further comprises:

a) a heel protective plate coupled to the midfoot protective plate.

20. The shoe of claim 19, wherein the forefoot protective plate, midfoot protective plate and heel protective plate are a single piece of material.

21. The shoe of claim 20, comprising a thin portion in the forefoot protective plate having a thickness of no more than 3 mm between the midfoot protective plate and heel protective plate to provide independent movement of the midfoot protective plate and heel protective plate.

22. The shoe of claim 18, wherein the thin portion between the forefoot protective plate and midfoot protective plate is a groove having a thickness of between 0.5 mm and 3 mm.

23. The shoe of claim 21, wherein the thin portion between the midfoot protective plate and heel protective plate is a groove having a thickness of between 0.5 mm and 3 mm.

24. The shoe of claim 1, further comprising a removable cushioning material between the protective plate and the insole.

* * * * *